US009932096B1

(12) United States Patent
George

(10) Patent No.: US 9,932,096 B1
(45) Date of Patent: Apr. 3, 2018

(54) BOAT LEVELING SYSTEM

(71) Applicant: Thomas George, Klawock, AK (US)

(72) Inventor: Thomas George, Klawock, AK (US)

( * ) Notice: Subject to any disclaimer, the term of this patent is extended or adjusted under 35 U.S.C. 154(b) by 0 days.

(21) Appl. No.: 15/597,487

(22) Filed: May 17, 2017

(51) Int. Cl.
*B63B 39/03* (2006.01)
*B63H 21/38* (2006.01)
*F02M 37/00* (2006.01)

(52) U.S. Cl.
CPC ..... *B63B 39/03* (2013.01); *B63H 21/38* (2013.01); *F02M 37/0052* (2013.01); *F02M 37/0076* (2013.01); *B63B 2770/00* (2013.01)

(58) Field of Classification Search
CPC ..... B63B 39/03; B63H 21/38
USPC ..... 114/122, 125
See application file for complete search history.

(56) References Cited

U.S. PATENT DOCUMENTS 3,054,373 A * 9/1962 Ripley ..... B63B 39/03 114/125
D272,630 S 2/1984 Koppens
4,759,307 A * 7/1988 Scott ..... B63B 43/04 114/121
6,283,142 B1 * 9/2001 Wheeler ..... F02M 37/0094 123/509
6,799,562 B2 * 10/2004 Pratt ..... F02M 37/007 123/198 D
6,845,782 B2 * 1/2005 Osterkil ..... B60K 15/077 137/1
7,069,913 B1 * 7/2006 Crary ..... F02M 37/0052 123/509
7,234,451 B2 * 6/2007 Betz, II ..... B60K 15/077 123/509
7,370,594 B2 * 5/2008 Bruckner ..... B63B 39/03 114/122

* cited by examiner

*Primary Examiner* — Lars A Olson
*Assistant Examiner* — Jovon Hayes

(57) ABSTRACT

A boat leveling system includes a boat that has a port side, a starboard side, a port fuel tank, a starboard fuel tank, a port fuel line, a starboard fuel line, an engine, an engine fuel return line and a fuel vent line. A leveling unit is positioned within the boat. The leveling unit is in fluid communication with the engine fuel return line to receive fuel. The leveling unit is in fluid communication with each of the port fuel line and the starboard fuel line. The leveling unit diverts the fuel to the port fuel line when the boat is listing to the starboard side. Thus, the port fuel unit receives additional fuel to level the boat. The leveling unit diverts the fuel to the starboard fuel line when the boat is listing to the port side. Thus, the starboard fuel unit receives additional fuel to level the boat.

13 Claims, 4 Drawing Sheets

BOAT LEVELING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to leveling devices and more particularly pertains to a new leveling device for leveling a boat.

BRIEF SUMMARY OF THE INVENTION

An embodiment of the disclosure meets the needs presented above by generally comprising a boat that has a port side, a starboard side, a port fuel tank, a starboard fuel tank, a port fuel line, a starboard fuel line, an engine, an engine fuel return line and a fuel vent line. A leveling unit is positioned within the boat. The leveling unit is in fluid communication with the engine fuel return line to receive fuel. The leveling unit is in fluid communication with each of the port fuel line and the starboard fuel line. The leveling unit diverts the fuel to the port fuel line when the boat is listing to the starboard side. Thus, the port fuel unit receives additional fuel to level the boat. The leveling unit diverts the fuel to the starboard fuel line when the boat is listing to the port side. Thus, the starboard fuel unit receives additional fuel to level the boat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
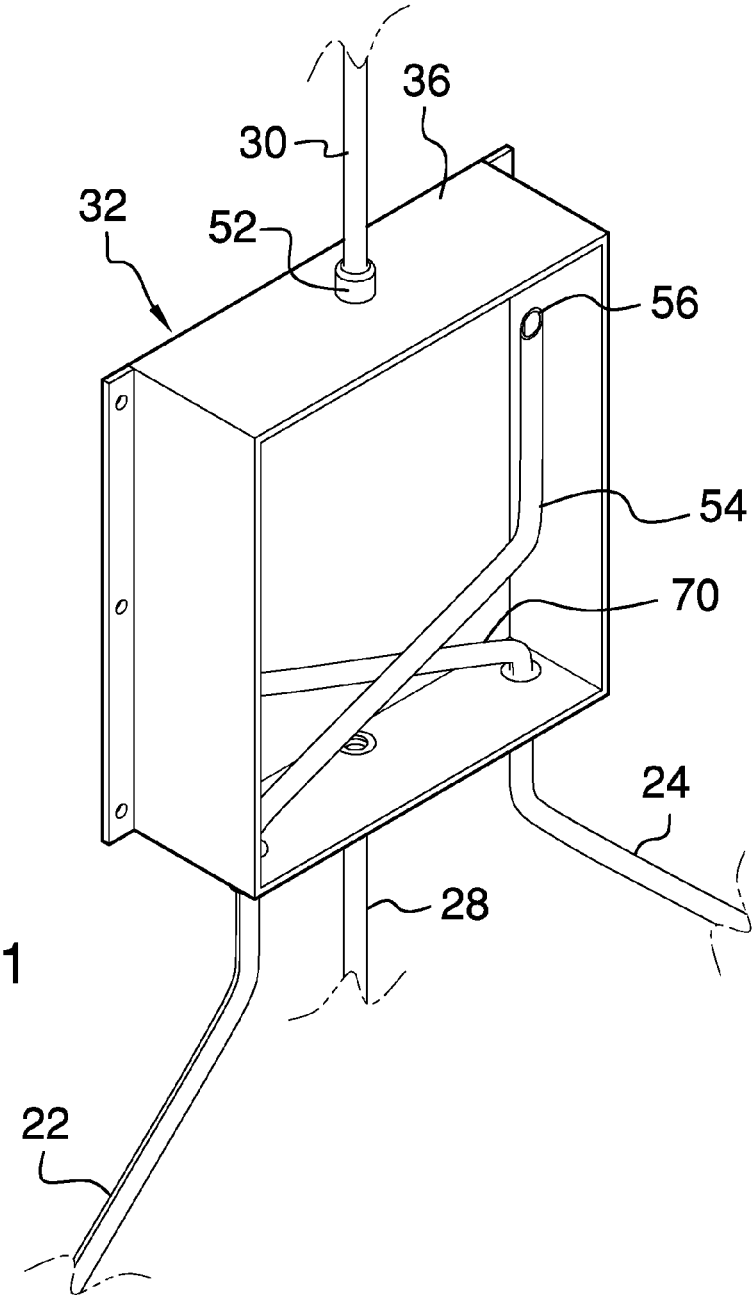
FIG. 1 is a perspective view of a container of a boat leveling system according to an embodiment of the disclosure.
Figure 2:
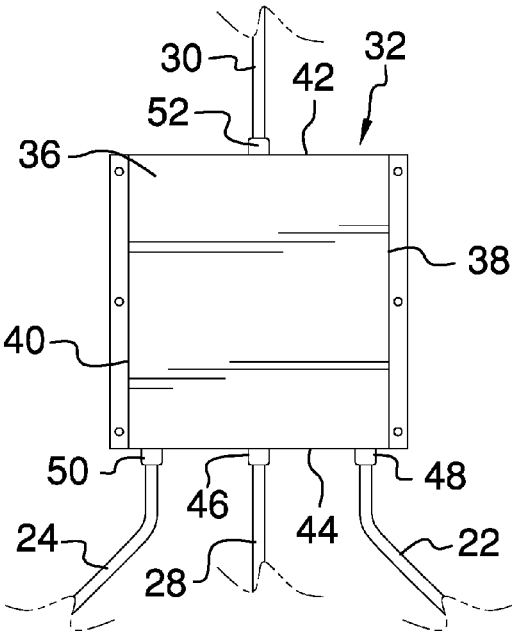
FIG. 2 is a bottom view of container of an embodiment of the disclosure.
Figure 3:
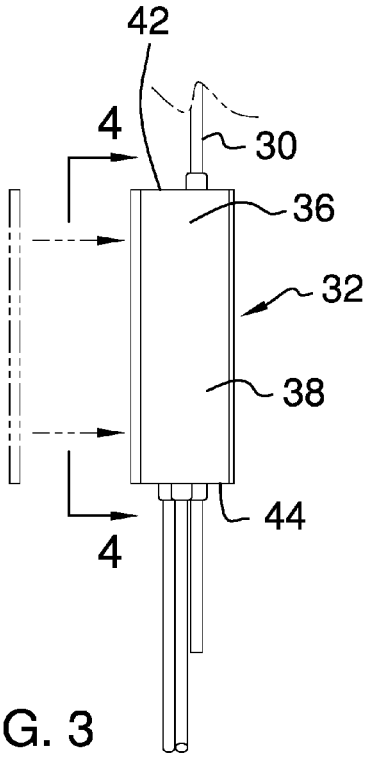
FIG. 3 is a right side view of a container of an embodiment of the disclosure.
Figure 4:
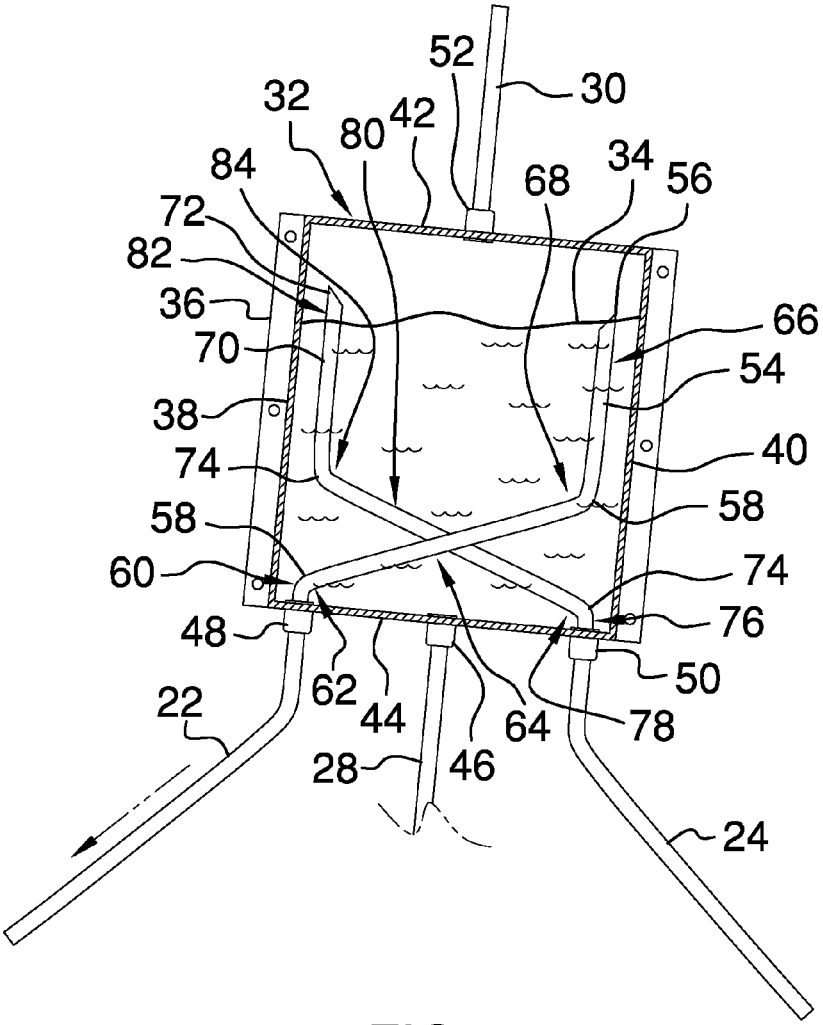
FIG. 4 is a front phantom view of a container of an embodiment of the disclosure.
Figure 5:
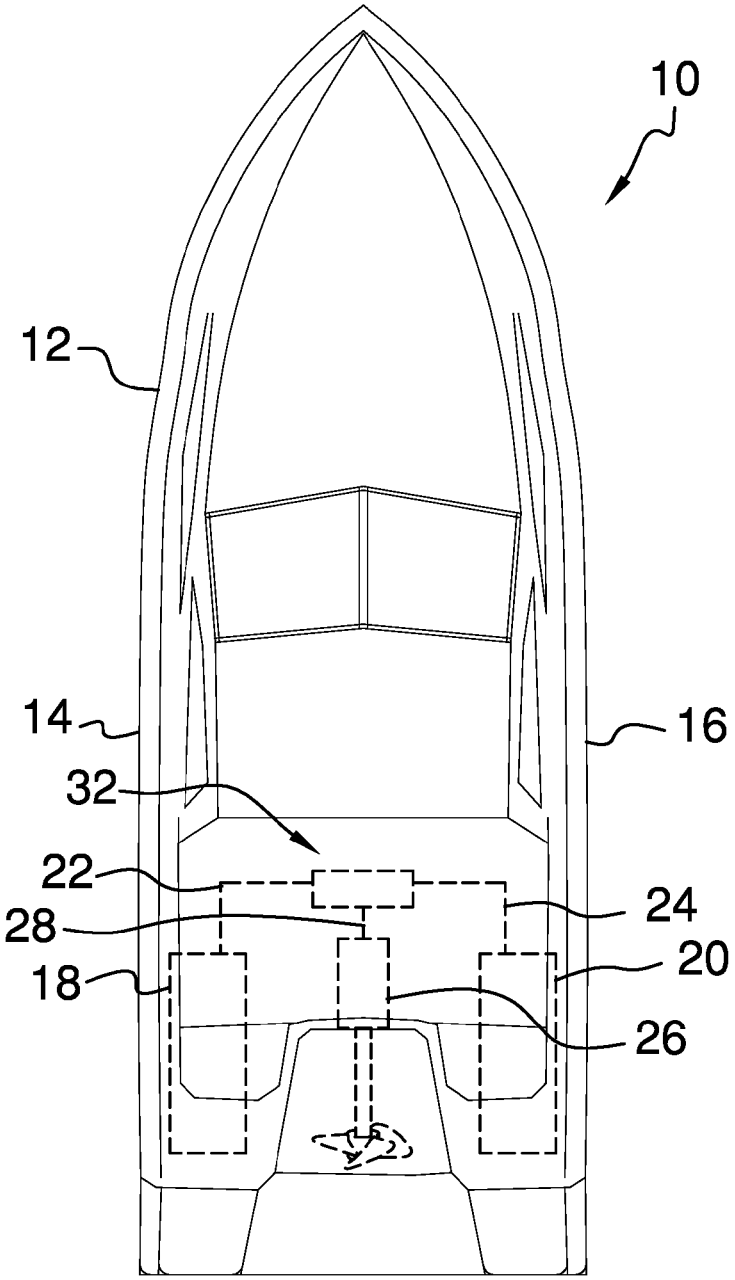
FIG. 5 is a phantom in-use view of an embodiment of the disclosure.

With reference now to the drawings, and in particular to FIGS. 1 through 5 thereof, a new leveling device embodying the principles and concepts of an embodiment of the disclosure and generally designated by the reference numeral 10 will be described.

As best illustrated in FIGS. 1 through 5, the boat leveling system 10 generally comprises a boat 12 that has a port side 14, a starboard side 16, a port fuel tank 18, and a starboard fuel tank 20. The boat 12 further includes a port fuel line 22 that is fluidly coupled to the port fuel tank 18, a starboard fuel line 24 that is fluidly coupled to the starboard fuel tank 20. Additionally, the boat 12 has an engine 26, an engine fuel return line 28 that is fluidly coupled to the engine 26 and a fuel vent line 30. The boat 12 may be a commercial boat, a private boat or any other boat that has a pair of fuel tanks.

A leveling unit 32 is provided and the leveling unit 32 is positioned within the boat 12. The leveling unit 32 is in fluid communication with the engine fuel return line 28. In this way the leveling unit 32 receives liquid fuel 34 from the engine 26. The leveling unit 32 is in fluid communication with each of the port fuel line 22 and the starboard fuel line 24. Thus, the leveling unit 32 diverts the fuel 34 to the port fuel line 22 when the boat 12 is listing to the starboard side 16. In this way the port fuel tank 18 receives additional fuel 34 to level the boat 12. The leveling unit 32 diverts the fuel 34 to the starboard fuel line 24 when the boat 12 is listing to the port side 14. In this way the starboard fuel tank 20 receives additional fuel 34 to level the boat 12.

The leveling unit 32 comprises a container 36 that has a first lateral wall 38, a second lateral wall 40, a front wall 42 and a back wall 44. The container 36 is mounted within the boat 12 having the first lateral wall 38 facing the port side 14 of the boat 12 and having the second lateral wall 40 facing the starboard side 16 of the boat 12. The container 36 may have a length and a width ranging between approximately 30.0 cm and 50.0 cm and a depth ranging between 5.0 cm and 10.0 cm. Additionally, the container 36 is comprised of a fluid impermeable material that conforms to maritime safety rules regarding liquid fuel storage.

An engine nipple 46 is coupled to the back wall 44 and the engine nipple 46 is in fluid communication with an interior of the container 36. The engine nipple 46 is fluidly coupled to the engine fuel return line 28. In this way the container 36 receives the fuel 34 from the engine 26. The engine nipple 46 is centrally positioned on the back wall 44. The engine nipple 46 may be a threaded fuel line coupling of any conventional design.

A port nipple 48 is coupled to the back wall 44 and the port nipple 48 is in fluid communication with the interior of the container 36. The port nipple 48 is fluidly coupled to the port fuel line 22. Moreover, the port nipple 48 is positioned between the engine nipple 46 and the first lateral wall 38 of the container 36. The port nipple 48 may be a threaded fuel line coupling of any conventional design.

A starboard nipple 50 is coupled to the back wall 44 and the starboard nipple 50 is in fluid communication with the interior of the container 36. The starboard nipple 50 is fluidly coupled to the starboard fuel line 24. Additionally, the starboard nipple 50 is positioned between the engine nipple 46 and the second lateral wall 40 of the container 36. The starboard nipple 50 may be a threaded fuel line coupling of any conventional design.

A vent nipple 52 is coupled to the front wall 42 and the vent nipple 52 is in fluid communication with the interior of the container 36. The vent nipple 52 is fluidly coupled to the fuel vent line 30 to vent fuel vapor from the container 36. Additionally, the vent nipple 52 may be a threaded fuel line coupling of any conventional design.

A port return line 54 is positioned within the container 36 and the port return line 54 is fluidly coupled to the port nipple 48. In this way the port return line 54 selectively diverts fuel 34 from the container 36 to the port fuel tank 18. The port return line 54 has a distal end 56 with respect to the port nipple 48 and the distal end 56 is open. The port return line 54 has a pair of bends 58 thereon. The bends 58 are spaced apart from each other and are distributed along the port return line 54 to form a first section 60 forming a first angle 62 with a middle section 64 and a second section 66 forming a second angle 68 with the middle section 64.

The first angle 62 is congruent with the second angle 68 such that the second section 66 is aligned with and is collinear with the second lateral wall 40 of the container 36. The distal end 56 is cut at an angle and the angle pertaining to the distal end 56 may be a 45.0 degree angle. The angle corresponding to the distal end 56 slopes downwardly between the second lateral wall 40 of the container 36 and the back wall 44 of the container 36. Thus, the distal end 56 receives the fuel 34 when the boat 12 is listing to the starboard side 16. In this way the fuel 34 increases a weight of the port fuel tank 18 with respect to the starboard fuel tank 20 thereby correcting the starboard listing.

A starboard return line 70 is positioned within the container 36 and the starboard return line 70 is fluidly coupled to the starboard nipple 50. In this way the starboard return line 70 selectively diverts fuel 34 from the container 36 to the starboard fuel tank 20. The starboard return line 70 has a distal end 72 with respect to the starboard nipple 50 and the distal end 72 of the starboard return line 70 is open. The starboard return line 70 has a pair of bends 74 thereon and the bends 74 are spaced apart from each other and are distributed along the starboard return line 70. The bends 74 on the starboard return line 70 forms a primary section 76 that forms a primary angle 78 with a central section 80 and a secondary section 82 forming a secondary angle 84 with the central section 80.

The primary angle 78 is congruent with the secondary angle 84 such that the secondary section 82 is aligned with and is collinear with the first lateral wall 38 of the container 36. The distal end 72 of the starboard return line 70 is cut at an angle and the angle corresponding to the distal end 72 of the starboard return line 70 may be a 45.0 degree angle. The angle corresponding to the distal end 72 of the starboard return line 70 slopes downwardly between the first lateral wall 38 of the container 36 and the back wall 44 of the container 36. Thus, the distal end 72 of the starboard return line 70 receives the fuel 34 when the boat 12 is listing to the port side 14. In this way the fuel 34 increases a weight of the starboard fuel tank 20 with respect to the port fuel tank 18 thereby correcting the port listing.

In use, the boat 12 is navigated on a water way. The container 36 receives the fuel 34 from the engine fuel return line 28. The fuel 34 flows into the starboard return line 70 when the boat 12 is listing to the port side 14. Thus, the fuel 34 in the container 36 is diverted into the starboard fuel tank 20 to correct the port side 14 listing. The fuel 34 flows into the port return line 54 when the boat 12 is listing to the starboard side 16. Thus, the fuel 34 in the container 36 is diverted into the port fuel tank 18 to correct the starboard side 16 listing. The leveling unit 32 facilitates the boat 12 to be leveled without requiring manual manipulation of valves or other conventional leveling equipment. Additionally, the absence of moving parts enhances a service life of the leveling unit 32 with respect to conventional leveling equipment.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A boat leveling system comprising:

a boat having a port side, a starboard side, a port fuel tank, a starboard fuel tank, a port fuel line being fluidly coupled to said port fuel tank, a starboard fuel line being fluidly coupled to said starboard fuel tank, an engine, an engine fuel return line being fluidly coupled to said engine and a fuel vent line;

a leveling unit being positioned within said boat, said leveling unit being in fluid communication with said engine fuel return line wherein said leveling unit is configured to receive fuel, said leveling unit being in fluid communication with each of said port fuel line and said starboard fuel line, said leveling unit diverting the fuel to said port fuel line when said boat is listing to said starboard side wherein said port fuel unit is configured to receive additional fuel to level said boat, said leveling unit diverting the fuel to said starboard fuel line when said boat is listing to said port side wherein said starboard fuel unit is configured to receive additional fuel to level said boat; and wherein said leveling unit comprises a container having a first lateral wall, a second lateral wall, a front wall and a back wall, said container being mounted within said boat having said first lateral wall facing said port side of said boat and having said second lateral wall facing said starboard side of said boat.

2. The system according to claim 1, further comprising a engine nipple being coupled to said back wall such that said engine nipple is in fluid communication with an interior of said container, said engine nipple being fluidly coupled to said engine fuel return line wherein said container is configured to receive the fuel, said engine nipple being centrally positioned on said back wall.

3. The system according to claim 2, further comprising a port nipple being coupled to said back wall such that said port nipple is in fluid communication with said interior of said container, said port nipple being fluidly coupled to said port fuel line, said port nipple being positioned between said engine nipple and said first lateral wall of said container.

4. The system according to claim 2, further comprising a starboard nipple being coupled to said back wall such that said starboard nipple is in fluid communication with said interior of said container, said starboard nipple being fluidly coupled to said starboard fuel line, said starboard nipple being positioned between said engine nipple and said second lateral wall of said container.

5. The system according to claim 1, further comprising a vent nipple being coupled to said front wall such that said vent nipple is in fluid communication with said interior of said container, said vent nipple being fluidly coupled to said vent line wherein said vent line is configured to vent fuel vapor from said container.

6. The system according to claim 3, further comprising a port return line being positioned within said container, said port return line being fluidly coupled to said port nipple wherein said port return line is configured to divert fuel from said container to said port fuel tank.

7. The system according to claim 6, wherein said port return line has a distal end with respect to said port nipple, said port return line having a pair of bends thereon, said bends being spaced apart from each other and being distributed between said distal end to form a first section forming a first angle with a middle section and a second section forming a second angle with said middle section.

8. The system according to claim 7, wherein said first angle is congruent with said second angle such that said second section is aligned with and being collinear with said second lateral wall of said container.

9. The system according to claim 8, wherein said distal end is open, said distal end being cut at an angle, said angle corresponding to said distal end sloping downwardly between said second lateral wall of said container and said back wall of said container wherein said distal end is configured to receive the fuel when said boat is listing to said starboard side thereby increasing a weight of said port fuel tank with respect to said starboard fuel tank.

10. The system according to claim 4, further comprising a starboard return line being positioned within said container, said starboard return line being fluidly coupled to said starboard nipple wherein said starboard return line is configured to divert fuel from said container to said starboard fuel tank.

11. The system according to claim 10, wherein said starboard return line has a distal end with respect to said starboard nipple, said starboard return line having a pair of bends thereon, said bends being spaced apart from each other and being distributed between said distal end of said starboard return line to form a primary section forming a primary angle with a central section and a secondary section forming a secondary angle with said central section, said primary angle being congruent with said secondary angle such that said secondary section is aligned with and being collinear with said first lateral wall of said container.

12. The system according to claim 11, wherein said distal end of said starboard return line is open, said distal end of said starboard return line being cut at an angle, said angle corresponding to said distal end of said starboard return line sloping downwardly between said first lateral wall of said container and said back wall of said container wherein said distal end of said starboard return line is configured to receive the fuel when said boat is listing to said port side thereby increasing a weight of said starboard fuel tank with respect to said port fuel tank.

13. A boat leveling system comprising:

a boat having a port side, a starboard side, a port fuel tank, a starboard fuel tank, a port fuel line being fluidly coupled to said port fuel tank, a starboard fuel line being fluidly coupled to said starboard fuel tank, an engine, an engine fuel return line being fluidly coupled to said engine and a fuel vent line; and a leveling unit being positioned within said boat, said leveling unit being in fluid communication with said engine fuel return line wherein said leveling unit is configured to receive fuel, said leveling unit being in fluid communication with each of said port fuel line and said starboard fuel line, said leveling unit diverting the fuel to said port fuel line when said boat is listing to said starboard side wherein said port fuel tank is configured to receive additional fuel to level said boat, said leveling unit diverting the fuel to said starboard fuel line when said boat is listing to said port side wherein said starboard fuel tank is configured to receive additional fuel to level said boat, said leveling unit comprising:

a container having a first lateral wall, a second lateral wall, a front wall and a back wall, said container being mounted within said boat having said first lateral wall facing said port side of said boat and having said second lateral wall facing said starboard side of said boat, a engine nipple being coupled to said back wall such that said engine nipple is in fluid communication with an interior of said container, said engine nipple being fluidly coupled to said engine fuel return line wherein said container is configured to receive the fuel, said engine nipple being centrally positioned on said back wall, a port nipple being coupled to said back wall such that said port nipple is in fluid communication with said interior of said container, said port nipple being fluidly coupled to said port fuel line, said port nipple being positioned between said engine nipple and said first lateral wall of said container, a starboard nipple being coupled to said back wall such that said starboard nipple is in fluid communication with said interior of said container, said starboard nipple being fluidly coupled to said starboard fuel line, said starboard nipple being positioned between said engine nipple and said second lateral wall of said container, a vent nipple being coupled to said front wall such that said vent nipple is in fluid communication with said interior of said container, said vent nipple being fluidly coupled to said vent line wherein said vent line is configured to vent fuel vapor from said container, a port return line being positioned within said container, said port return line being fluidly coupled to said port nipple wherein said port return line is configured to divert fuel from said container to said port fuel tank, said port return line having a distal end with respect to said port nipple, said port return line having a pair of bends thereon, said bends being spaced apart from each other and being distributed between said distal end to form a first section forming a first angle with a middle section and a second section forming a second angle with said middle section, said first angle being congruent with said second angle such that said second section is aligned with and being collinear with said second lateral wall of said container, said distal end being open, said distal end being cut at an angle, said angle corresponding to said distal end sloping downwardly between said second lateral wall of said container and said back wall of said container wherein said distal end is configured to receive the fuel when said boat is listing to said starboard side thereby increasing a weight of said port fuel tank with respect to said starboard fuel tank, and a starboard return line being positioned within said container, said starboard return line being fluidly coupled to said starboard nipple wherein said starboard return line is configured to divert fuel from said container to said starboard fuel tank, said starboard return line having a distal end with respect to said starboard nipple, said starboard return line having a pair of bends thereon, said bends being spaced apart from each other and being distributed between said distal end of said starboard return line to form a primary section forming a primary angle with a central section and a secondary section forming a secondary angle with said central section, said primary angle being congruent with said secondary angle such that said secondary section is aligned with and being collinear with said first lateral wall of said container, said distal end of said starboard return line being open, said distal end of said starboard return line being cut at an angle, said angle corresponding to said distal end of said starboard return line sloping downwardly between said first lateral wall of said container and said back wall of said container wherein said distal end of said starboard return line is configured to receive the fuel when said boat is listing to said port side thereby increasing a weight of said starboard fuel tank with respect to said port fuel tank.

* * * * *